US007928911B2

(12) United States Patent
Chen et al.

(10) Patent No.: US 7,928,911 B2
(45) Date of Patent: Apr. 19, 2011

(54) DIGITAL TELEVISION (DTV) ANTENNA APPARATUS

(75) Inventors: Yen-Yu Chen, Chung Ho (TW); Kuo-Ying Su, Chung Ho (TW); Yung-Da Lin, Chung Ho (TW)

(73) Assignee: Avermedia Technologies, Inc., Chung Ho, Taipei Hsien (TW)

( * ) Notice: Subject to any disclaimer, the term of this patent is extended or adjusted under 35 U.S.C. 154(b) by 380 days.

(21) Appl. No.: 12/146,886

(22) Filed: Jun. 26, 2008

(65) Prior Publication Data

US 2009/0256753 A1 Oct. 15, 2009

(30) Foreign Application Priority Data

Apr. 15, 2008 (TW) ..... 97113633 A

(51) Int. Cl.
*H01Q 9/04* (2006.01)

(52) U.S. Cl. ..... 343/700 MS; 343/702

(58) Field of Classification Search ..... 343/700, 343/702, 700 MS

See application file for complete search history.

(56) References Cited

U.S. PATENT DOCUMENTS 4,749,996 A * 6/1988 Tresselt ..... 343/700 MS
2006/0267834 A1* 11/2006 Qi et al. ..... 342/357.1

FOREIGN PATENT DOCUMENTS

JP H09-260934 * 3/1997
WO 01/63690 * 8/2001

* cited by examiner

*Primary Examiner* — Jacob Y Choi
*Assistant Examiner* — Darleen J Stockley
(74) *Attorney, Agent, or Firm* — Thomas, Kayden, Horstemeyer & Risley, LLP

(57) ABSTRACT

The present invention discloses a DTV antenna apparatus build in a portable device. The portable device includes a system ground. The DTV antenna includes a ground plane with a short circuit point, an extending metal arm with a grounding point and a radiation element. The ground plane is the system ground. The radiation element and the ground plane are arranged in parallel to each other. The extending metal arm connects with the short circuit point. The antenna receives signals with frequencies in the range from 470 MHz to 870 MHz. The radiation element includes a radiation arm and a parasitic arm. The radiation arm has a feeding terminal. The parasitic arm connects with the short circuit point.

16 Claims, 4 Drawing Sheets

30

DIGITAL TELEVISION (DTV) ANTENNA APPARATUS

RELATED APPLICATIONS

This application claims priority to Taiwan Application Serial Number 97113633, filed Apr. 15, 2008, which is herein incorporated by reference.

FIELD OF THE INVENTION

The present invention relates to an antenna apparatus, and especially to an inside digital television (DTV) antenna.

BACKGROUND OF THE INVENTION

The key development in communication technology has been the transfer from wired to wireless communication. In the field of wireless communication, the signal propagates through the air in the form of an electromagnetic wave, where the bridge of the signals between the wireless device and the air is an antenna.

Because the operation frequency of the DTV is between 470 MHz to 870 MHz, the conventional DTV antenna is usually attached to the exterior of the device. A variety of problems are inherent to this arrangement, however. For example, external forces easily damage such an antenna, the overhead of the circuit design is increased and the device is harder to carry. For these reasons, the external antenna is increasingly unsuited for use in advanced wireless communication devices.

Therefore, it is apparent that the DTV antenna built in portable devices will be a mainstream trend in the communications field.

SUMMARY OF THE INVENTION

Therefore, the main purpose of the present invention is to provide a digital television (DTV) antenna built in portable devices.

In accordance with the foregoing purpose, the present invention discloses a DTV antenna apparatus built in a portable device. The portable device includes a system ground. The DTV antenna includes a ground plane with a short circuit point, an extending metal arm with a grounding point and a radiation element. The ground plane is the system ground. The radiation element and the ground plane are arranged in parallel to each other. The extending metal arm connects with the short circuit point. The antenna receives frequencies in the range from 470 MHz to 870 MHz. The radiation element includes a radiation arm and a parasitic arm. The radiation arm has a feeding terminal. The parasitic arm connects with the short circuit point.

According to an embodiment, the radiation arm includes a first body and a first extending arm. The first extending arm extends from one side of the first body and is almost perpendicular to the side. A cross section constructed by the first extending arm and the side has an appearance similar to a step. The parasitic arm includes a second body and a second extending arm. The second extending arm extends from one side of the second body and is almost perpendicular to the side. The second extending arm is extended to connect with the short circuit point. The second body is located between the ground plane and the first body.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 1:
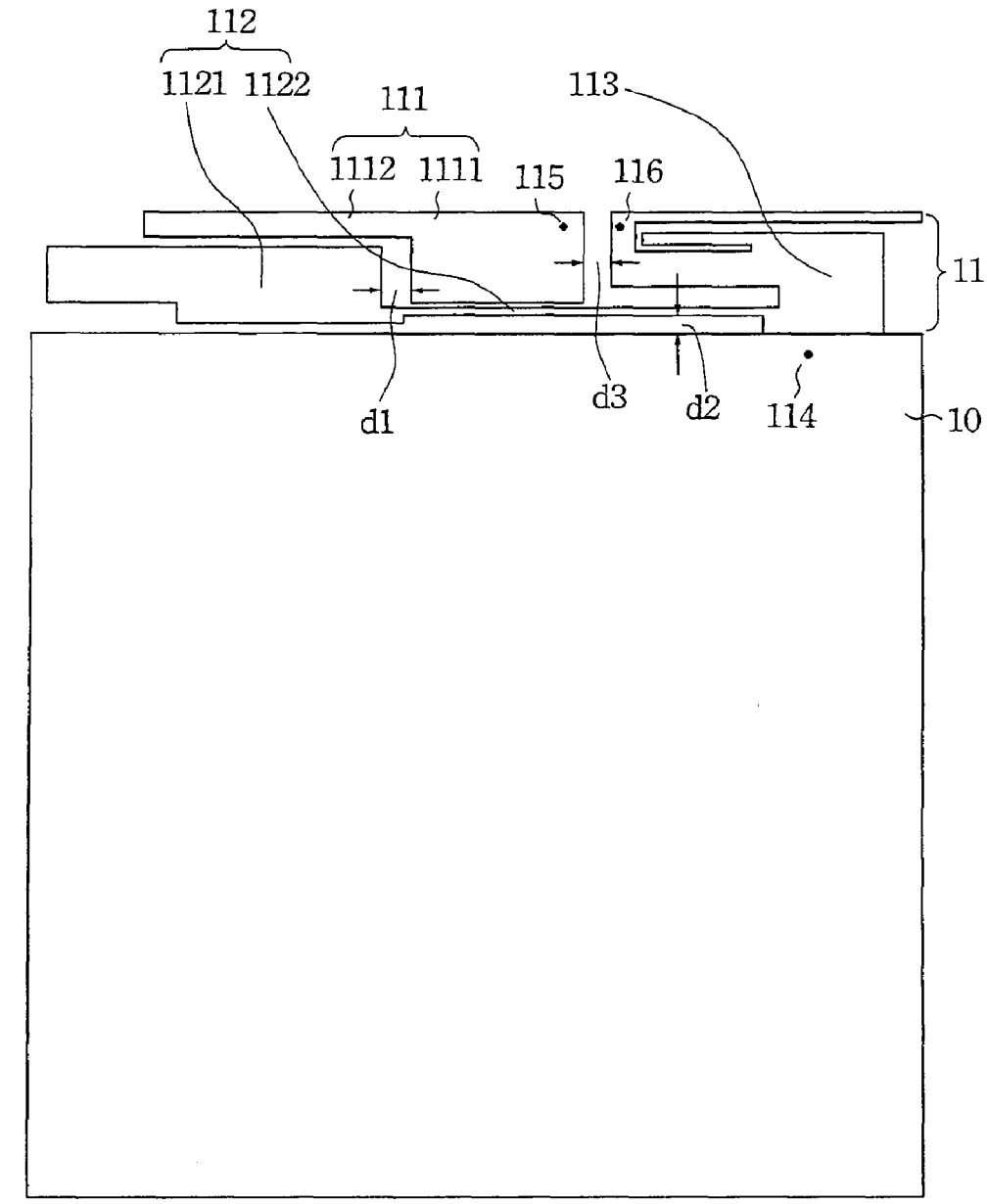
FIG. 1 is a schematic diagram of the DTV antenna in accordance with a first embodiment of the present invention.

FIG. 1 is a schematic diagram of the digital television (DTV) antenna in accordance with a first embodiment of the present invention. The DTV antenna 100 is built in a portable device to receive frequencies in the range from 470 MHz to 870 MHz. The portable device is, for example, a portable computer, a mini computer or a portable Internet device.

The DTV antenna 100 includes a ground plane 10 and a radiation element 11. The ground plane 10 has a short circuit point 114. The radiation element 11 and the ground plane 10 are located in a same plane and in parallel to each other. However, in another embodiment, the radiation element 11 and the ground plane 10 are not arranged in a same plane. The radiation element 11 includes a radiation arm 111 and a parasitic arm 112. The radiation arm 111 has a feeding terminal 115. The parasitic arm 112 connects with the short circuit point 114. In this embodiment, the system ground plane of the portable device is served as the ground plane 10 of the DTV antenna 100. Therefore, in the present invention, it is not necessary to build an additional ground plane. The ground plane 10, for example, is the system ground plane of a liquid crystal display or a portable computer. The radiation arm 111 and a parasitic arm 112, for example, are formed by metalwork technology. In an embodiment, an etching process or a printing process attaches the radiation arm 111 and a parasitic arm 112 in a dielectric substrate.

In an embodiment, an extending metal arm 113 is adjacent to the radiation arm 111. The extending metal arm 113 extends from the ground plane 10 and connects with the short circuit point 114. The extending metal arm 113 has a grounding point 116 and has a bent appearance to make the grounding point 116 and the feeding terminal 115 close. The closed grounding point 116 and feeding terminal 115 are helpful to connect with a coaxial line (not shown in this figure). In this embodiment, the extending metal arm 113 connects with the parasitic arm 112. Therefore, the extending metal arm 113 and the parasitic arm 112 are integrated built. The distance between the radiation arm 111 and the extending metal arm 113 is 1 mm, but the embodiment does not limit the distance in practice. The extending metal arm 113 has an appearance similar to a reversed "L", but the embodiment does not limit the appearance in practice.

The feeding terminal 115 and the grounding point 116 connect with a coaxial cable (not shown in the figure). The feeding terminal 115 connects with the inner copper core of the coaxial cable. The ground point 116 connects with copper screen of the coaxial cable. Current is fed into the radiation arm 111 from the inner copper core through the feeding terminal 115. In another embodiment, the extending metal arm 113 is removed. In this case, the feeding terminal 115 connects with the inner copper core of the coaxial cable. The grounding plane 10 connects with copper screen of the coaxial cable.

According to an embodiment, a small rectangular slice is severed from a metal slice to form the radiation arm 111. The radiation arm includes a body 1111 and an extending arm 1112. The extending arm 1112 extends from one side of the body 1111 and is almost perpendicular to the side. A cross section constructed by the extending arm 1112 and the side has an appearance similar to a step. In another embodiment, the radiation arm only includes the body 1111. That is that no extending arm 1112 extends from the body 1111.

The parasitic arm 112 is also formed by severing a small rectangular slice from a metal slice. The parasitic arm 112 includes a body 1121 and an extending arm 1122. The extending arm 1122 extends from one side of the body 1121 and is almost perpendicular to the side. The extending arm 1122 *i* connects with the short circuit point 114. A cross section constructed by the extending arm 1122 and the side has an appearance similar to a step. According to an embodiment, the radiation arm 111 is located in the location adjacent to one side of the ground plane 10 with the short circuit point 114. This location is not near the short circuit point 114. Therefore, an extending arm 1122 longer than the body 1111 is required to connect the body 1121 to the short circuit point 114. The body 1121 is located between the extending arm 1112 and ground plane 10. The extending arm 1122 is located between the body 1111 and the ground plane 10. In an embodiment, the area of the body 1111 is larger than that of the body 1121. The distance d1 between the body 1111 and the body 1121 is in the range from 2 mm to 4 mm. The distance d2 between the extending arm 1122 and the ground plane 10 is in the range from 0.5 mm to 1 mm. The distance d3 between the body 1111 and the extending metal arm 113 is in the range from 0.5 mm to 1.5 mm. However, in other embodiments, the distances d1, d2 and d3 are changeable based on the DTV antenna design. The radiation arm 111 and the parasitic arm 112 operate at a frequency band between 470 MHz and 870 MHz. The frequency band can be changed by varying the sizes of the radiation arm 111 or/and the parasitic arm 112.

Figure 2:
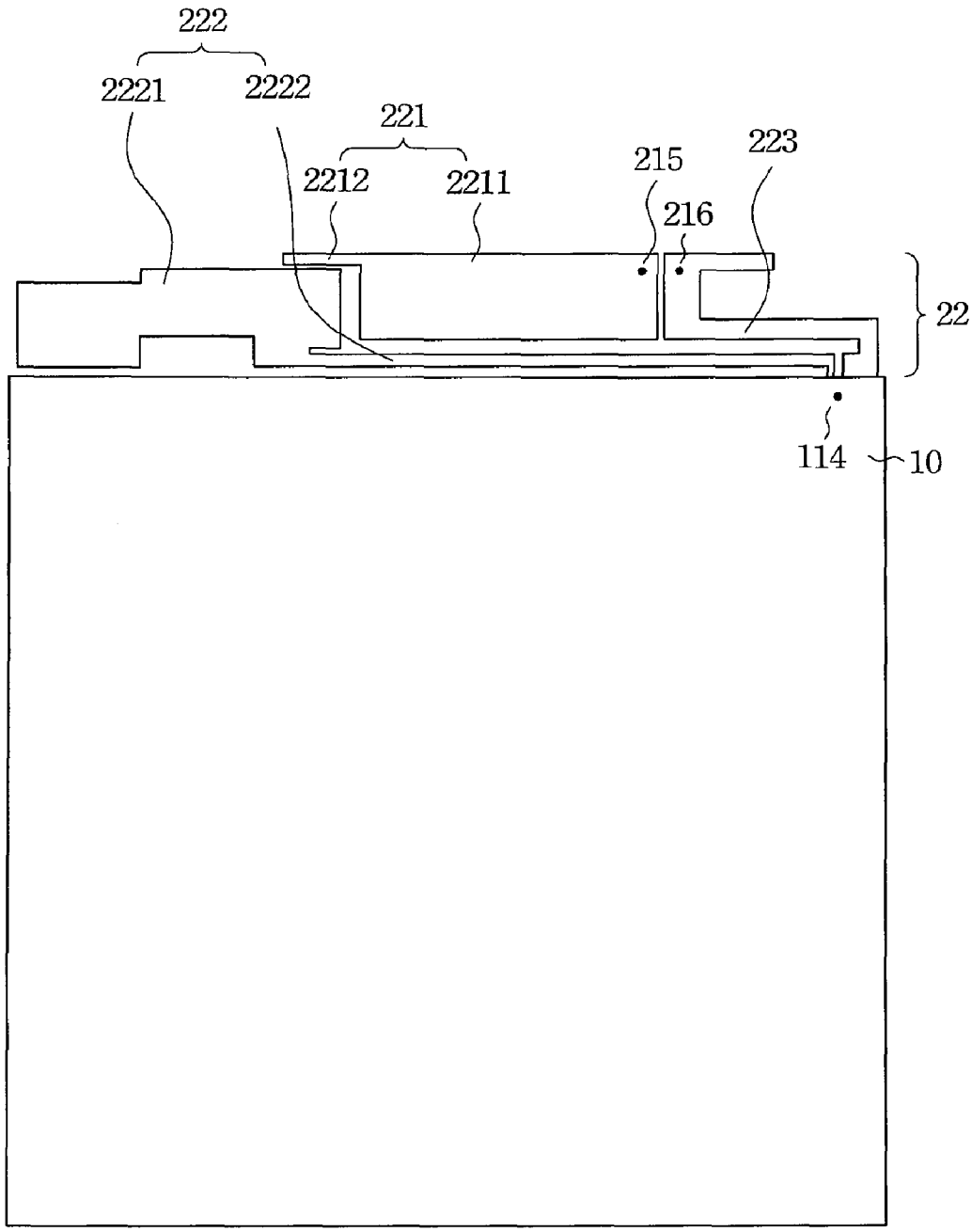
FIG. 2 is a schematic diagram of the DTV antenna in accordance with a second embodiment of the present invention.

FIG. 2 is a schematic diagram of the DTV antenna in accordance with a second embodiment of the present invention. The DTV antenna 200 includes a ground plane 10 and a radiation element 22. The ground plane 10 has a short circuit point 114. The radiation element 22 includes a radiation arm 221, a parasitic arm 222 and an extending metal arm 223. The radiation arm 221 has a feeding terminal 115. The extending metal arm 223 has a grounding point 216. The parasitic arm 222 and the extending metal arm 223 connect with the short circuit point 114. The radiation arm 221 includes a body 22111 and an extending arm 2212. The extending arm 2212 extends from one side of the body 2211 and is almost perpendicular to the side. A cross section constructed by the extending arm 2212 and the side has an appearance similar to a step.

The parasitic arm 222 includes a body 2221 and an extending arm 2222. The extending arm 2222 extends from one side of the body 2221 and is almost perpendicular to the side. The extending arm 2222 connects with the short circuit point 114. The feeding terminal 115 and the grounding point 116 connect with a coaxial cable (not shown in the figure). The feeding terminal 115 connects with the inner copper core of the coaxial cable. The grounding point 116 connects with copper screen of the coaxial cable. The parasitic arm 222 and the extending metal arm 223 are separated in the second embodiment. However, the parasitic arm 112 and the extending metal arm 113 are connected together in the first embodiment.

Figure 3:
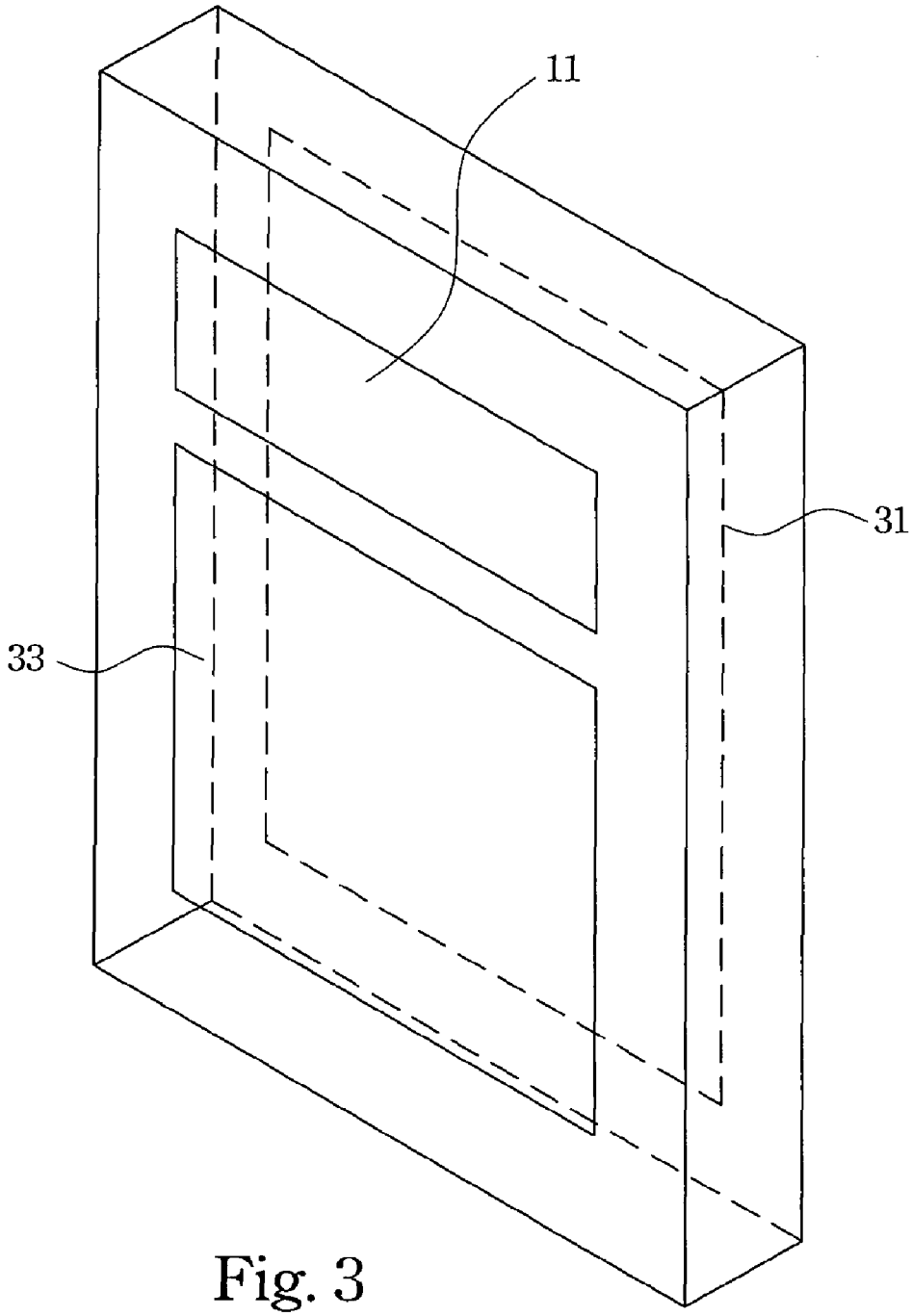
FIG. 3 is a schematic diagram of the DTV antenna disposed in a portable device.

FIG. 3 is a schematic diagram of the DTV antenna disposed in a portable device. In this embodiment, the portable device 30 has a liquid crystal display 31 and a system ground plane 33. The radiation element 11 or 22 is built in the portable device 30 and connected to the system ground plane 33 to operate at a frequency band between 470 MHz and 870 MHz. In another embodiment, the portable device 30 is a portable computer.

Figure 4:
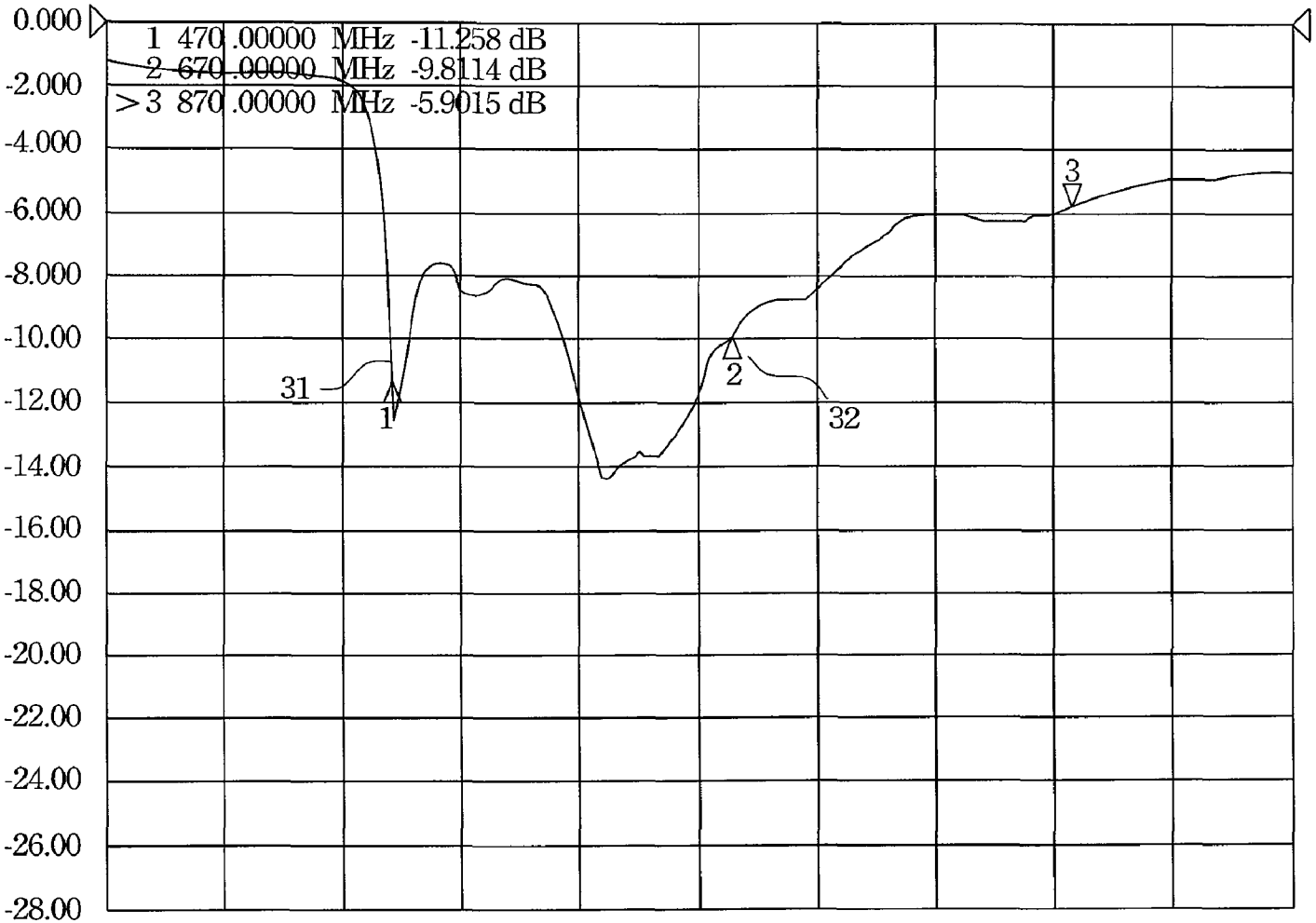
FIG. 4 is a test chart of return loss for the DTV antenna of the present invention.

FIG. 4 is a test chart of return loss for the DTV antenna of the present invention. The size of the DTV antenna for test is described in the following. The length is 300 mm and the width is 250 mm of the ground plane. A rectangular slice whose length is 11 mm and width is 9 mm is severed from a metal slice whose length is 50.5 mm and width is 10 mm to form the radiation arm 111. A rectangular slice whose length is 64 mm and width is 12.5 mm is severed from a metal slice whose length is 64 mm and width is 13 mm to form the parasitic arm 112. According to the test chart, the DTV antenna includes two modes 31 and 32. The two modes 31 and 32 can be changed by varying the sizes of the radiation arm or/and the parasitic arm. The return loss is over 6 dB.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A digital television (DTV) antenna apparatus built in a portable device, wherein the portable device has a system ground plane, comprising:

a ground plane with a short circuit point, wherein the ground plane is the system ground plane;

an extending metal arm with a grounding point, wherein the extending metal arm connects with the short circuit point;

a radiation element to receive the frequency in the range from 470 MHz to 870 MHz, wherein the radiation element and the ground plane are arranged in parallel to each other, further comprises:

a radiation arm with a feeding terminal; and a parasitic arm including a first body and a first extending arm, wherein the first extending arm extends from one side of the first body and is almost perpendicular to the side, the first extending arm is extended to connect with the short circuit point, a cross section constructed by the first extending arm and the side has an appearance similar to a step, wherein the radiation arm includes a second body and a second extending arm, the second extending arm extends from one side of the second body and is almost perpendicular to the side, a cross section constructed by the second extending arm and the side has an appearance similar to a step.

2. The DTV antenna apparatus of claim 1, wherein the first body is located between the second extending arm and the ground plane.

3. The DTV antenna apparatus of claim 2, wherein the first extending arm is located between the second body and the ground plane.

4. The DTV antenna apparatus of claim 1, wherein a distance between the first body and the radiation arm is from 2 mm to 4 mm.

5. The DTV antenna apparatus of claim 1, wherein a distance between the first extending arm and the ground plane is from 0.5 mm to 1 mm.

6. The DTV antenna apparatus of claim 1, wherein a distance between the radiation arm and the extending metal arm is from 0.5 mm to 1.5 mm.

7. The DTV antenna apparatus of claim 1, wherein the size of the second body is larger than that of the first body.

8. The DTV antenna apparatus of claim 1, wherein the extending metal arm is integrally built with the parasitic arm.

9. The DTV antenna apparatus of claim 1, wherein the feeding terminal connects with an inner copper core of a coaxial cable, the grounding point connects with a copper screen of the coaxial cable.

10. The DTV antenna apparatus of claim 1, wherein the ground plane and the radiation element are located in a same plane.

11. The DTV antenna apparatus of claim 1, wherein the radiation arm is formed by severing a small rectangular slice from a metal slice.

12. The DTV antenna apparatus of claim 1, wherein the radiation element is formed on a substrate.

13. The DTV antenna apparatus of claim 12, wherein the substrate is a dielectric substrate.

14. The DTV antenna apparatus of claim 13, wherein the radiation element is formed in the dielectric substrate by a etching technology or a printing technology.

15. The DTV antenna apparatus of claim 1, wherein the parasitic arm is formed by severing a small rectangular slice from a metal slice.

16. The DTV antenna apparatus of claim 1, wherein the ground plane is a ground plane of a liquid crystal display.

* * * * *